US006390600B1

(12) United States Patent
Vega et al.

(10) Patent No.: US 6,390,600 B1
(45) Date of Patent: May 21, 2002

(54) INK JET DEVICE HAVING VARIABLE INK EJECTION

(75) Inventors: Ramon Vega, Sabadell; Xavier Bruch, Sant Cugat del Valles, both of (ES)

(73) Assignee: Hewlett-Packard Company, DE (US)

( * ) Notice: Subject to any disclaimer, the term of this patent is extended or adjusted under 35 U.S.C. 154(b) by 0 days.

(21) Appl. No.: 09/843,879

(22) Filed: Apr. 30, 2001

(51) Int. Cl.[7] ..... B41J 2/14; B41J 2/16; B41J 2/17

(52) U.S. Cl. ..... 347/48; 347/94

(58) Field of Search ..... 347/56, 48, 84, 347/85, 89, 92, 94

(56) References Cited

U.S. PATENT DOCUMENTS

| | | | | | |
|---|---|---|---|---|---|
| 4,251,824 | A | * | 2/1981 | Hara et al. | 347/48 |
| 4,459,600 | A | | 7/1984 | Sato et al. | 347/56 |
| 4,494,128 | A | * | 1/1985 | Vaught | 347/48 |
| 4,716,418 | A | | 12/1987 | Heinzl et al. | 347/11 |
| 4,897,674 | A | * | 1/1990 | Hirasawa | 347/94 |
| 5,708,466 | A | | 1/1998 | Noguchi | 347/65 |
| 5,872,582 | A | * | 2/1999 | Pan | 347/65 |
| 5,897,789 | A | * | 4/1999 | Weber | 347/65 |
| 6,126,259 | A | | 10/2000 | Stango et al. | 347/9 |

* cited by examiner

*Primary Examiner*—John Barlow
*Assistant Examiner*—Juanita Stephens

(57) ABSTRACT

An ink jet device for printing onto a print medium and a method for modulating the ink discharged from the ink jet device. The ink jet device has a first fluid path, a second fluid path, and a discharge opening provided between the first and second fluid paths. The first fluid path possesses at least one heat generating element to substantially heat and vaporize a portion of printer fluid located in the vicinity of the heat generating elements. By virtue of the printer fluid vaporization, pressure is created in the printer fluid to cause a portion of the printer fluid located upstream of the vaporized section to move in a direction generally toward the second fluid path. The at least one heat generating element is activated to push a desired section of the printer fluid toward the discharge opening. The flow of the printer fluid through the second fluid path may be substantially impeded to thus force a desired amount of printer fluid to be ejected through the discharge opening. By controlling the timing of the impedance, the amount of printer fluid as well as the amount of vaporized printer fluid ejected may be varied. According to one aspect, a blocking system possessing a plurality of walls and heat generating components may be utilized to substantially impede the flow of the printer fluid throughout various positions of the ink jet device.

25 Claims, 4 Drawing Sheets

INK JET DEVICE HAVING VARIABLE INK EJECTION

FIELD OF THE INVENTION

This invention relates generally to ink jet printers. More particularly, the invention pertains to an ink jet device capable of firing fluid through a nozzle at relatively high speeds and at variable volumes, i.e., the ink jet device may expel just fluid, vapor, or a combination of fluid and vapor, such that the amount of ejected vapor and fluid may be modulated.

BACKGROUND OF THE INVENTION

Ink jet recording is a method of forming ink droplets by discharging recording fluid (e.g., ink) from an orifice provided in a recording head. The ink droplets adhere to a recording medium (e.g., paper) by being "fired" at the recording medium. Devices operating an ink jet recording method typically utilize impulse fluid or ink jets designed and driven to eject a droplet of recording fluid through an orifice of the ink jet. In general, it is unnecessary to operate ink jet devices at high performance levels, i.e., at high velocities and long throw distances. However, it has been found that many applications, including industrial applications, require high-performance ink jet devices. In one respect, in various industrial ink jet applications, the print medium may be located some distance from the ink jet orifice. To maintain a relatively small droplet size and create a high resolution dot on the print medium in these types of applications, it is relatively important for the ink jet devices to be operated at high-performance levels.

In addition to the above, it is advantageous to control the amount of ink volume and vapor volume, such that the dot formed on the print medium from the ink droplet may have an additional amount of controllability.

Conventional ink jet recording devices, however, suffer from a variety of drawbacks and disadvantages. For example, FIG. 1, which depicts a conventional thermal ink jet recording device (U.S. Pat. No. 4,459,600, issued to Sato et al.), shows a recording head 1, having a supply of liquid 3 being provided by an external liquid feeding device through a liquid feeding path 6 at a pressure P. In this figure, the pressure P is not sufficient to discharge the liquid from a discharge orifice 2. A heat generating body 4, an expedient to generate heat energy, is positioned in a heat acting zone 5, where the generated heat energy acts on the liquid 3. The liquid 3 in the heat acting zone 5 undergoes changes in its state (liquid volume expansion or generation of foams) effective to discharge the formed droplets through a liquid discharge path 7. That is, the heat generating body 4 typically generates sufficient heat to change the state of the liquid 3 in the heat acting zone 5 to create sufficient pressure to eject a certain amount of liquid through the discharge orifice 2.

As illustrated in FIG. 1, the amount of liquid 3 supplied and maintained in the liquid discharge path 7 generally represents the amount of liquid to be ejected through the discharge orifice 2. In this respect, the amount of liquid ejected through discharge orifice 2 remains relatively constant for each amount of liquid ejected. Thus, because the amount of liquid in the liquid discharge path 7 remains substantially constant, the recording head 1 illustrated in FIG. 1, is not capable of modulating the amount of liquid ejected through the discharge orifice 2.

Other conventional types of recording heads utilize a similar design to that described above to alter the phase of the liquid to create sufficient pressure for liquid positioned in front of the altered liquid to be ejected through an orifice. Examples of conventional types of thermal recording heads include, U.S. Pat. No. 4,716,418, issued to Heinzl et al., U.S. Pat. No. 5,708,466, issued to Noguchi, and U.S. Pat. No. 6,126,259, issued to Stango et al. These conventional types of recording heads all suffer from the same or similar disadvantages as noted above with respect to FIG. 1. For example, none of these types of recording heads enables a variable amount of liquid to be ejected from the recording head. More specifically, all of the above cited types of recording heads are operable to eject only that amount of liquid positioned between the heat generating element and a discharge orifice.

SUMMARY OF THE INVENTION

In accordance with the principles of the present invention, an ink jet device includes a first fluid path, a second fluid path, and a discharge opening through which a printer fluid is configured to be ejected from the ink jet device. The discharge opening is located between the first fluid path and the second fluid path. The ink jet device also includes at least one heat generating element located in the first fluid path for heating the printer fluid in the first fluid path, and a first closure device for substantially impeding a flow of the printer fluid through the second fluid path.

According to another aspect, the present invention pertains to a method of recording on a printing medium. According to the method, a first fluid path and a second fluid path are substantially filled with printer fluid. At least one heat generating element located in the first fluid path is activated to heat and substantially vaporize a first portion of the printer fluid located in the first fluid path. A second portion of the printer fluid travels towards the second fluid path in response to the first portion of the printer fluid becoming heated and vaporized. In addition, a flow of the printer fluid through the second fluid path is substantially impeded to thereby cause at least a portion of the printer fluid to be ejected through a discharge opening located between the first fluid path and the second fluid path.

In accordance with yet another aspect, the present invention pertains to a method for modulating a characteristic of a printer fluid ejected from an ink jet device. According to the method, a printer fluid is heated to cause a first portion of the printer fluid to become heated and vaporized. The vaporized first portion thus creates a predetermined amount of pressure within a first fluid path of the ink jet device, thereby causing a second portion of the printing fluid to be forced toward a second fluid path of the ink jet device. Additionally, the flow of the printer fluid in the second fluid path is substantially impeded at a predetermined time after the heating step to thereby cause at least a portion of the printer fluid to be ejected through a discharge opening located between the first and second fluid paths.

By virtue of the configuration and manner by which the printer fluid in an ink jet device according to the principles of the present invention may be operated, various advantages may be obtained by practicing various aspects of the present invention. For example, high pressure colored steam or ink vapor may be used to print light colors, accelerate drying time of the printed output, etc. Additionally, vapor ejection may be used in other processes in the printing industry, e.g., surface treatments, micro humidity control, to clean/purge small instruments, etc. Thus, certain aspects of the present invention are configured to overcome certain drawbacks and disadvantages associated with known ink jet printer devices.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof, particularly with references to an example of an ink jet device. However, one of ordinary skill in the art would readily recognize that the same principles are equally applicable to, and can be implemented in, any device that utilizes a nozzle to eject ink droplets at a relatively rapid rate, and that any such variation would be within such modifications that do not depart from the true spirit and scope of the present invention.

Figure 1:
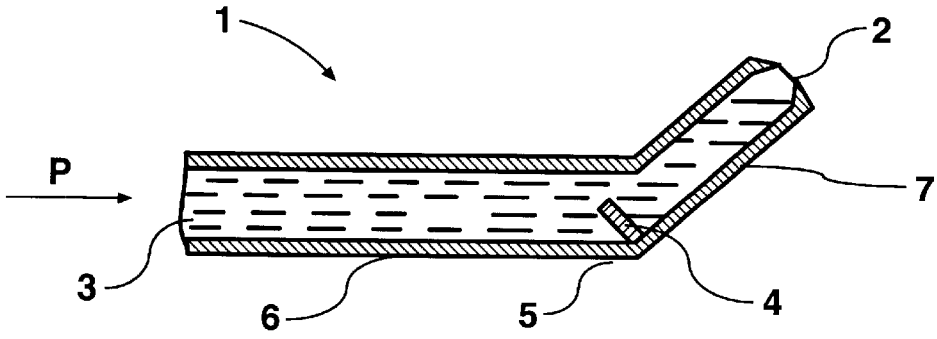
FIG. 1 PRIOR ART
FIG. 1 illustrates a recording head of a conventional thermal liquid jet recording device.
Figure 2:
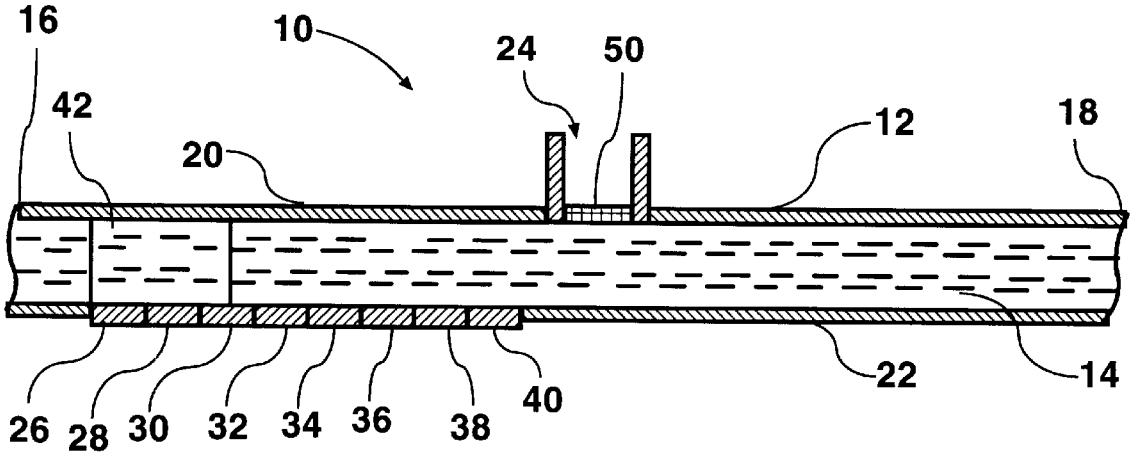
FIG. 2 illustrates a simplified cross-sectional view of an ink jet device according to the principles of the present invention.

With reference to FIG. 2, a simplified cross-sectional view of an ink jet device 10 is illustrated according to the principles of the present invention. As seen in FIG. 2, the ink jet device 10 includes a generally tubular member 12 having end sections 16, 18. A printer fluid 14 (e.g., black ink, colored ink, etc.) is supplied into the generally tubular member 12 through either one or both of the end sections 16, 18. The printer fluid 14 may be supplied to the ink jet device 10 in a variety of ways, such as, an external liquid feeding tank (not shown), a liquid feeding tube (not shown), a filter (not shown), and the like. Each of the various ways described above may be attached to one or both of end sections 16, 18 of the generally tubular member 12.

With further reference to FIG. 2, it may be seen that the ink jet device 10 is composed of a first printer fluid path 20 and a second printer fluid path 22. A discharge opening 24 is located between the first and second printer fluid paths 20, 22. The discharge opening 24 is illustrated as having a discharge opening closure device 50 for substantially preventing undesired flow of printer fluid 14 through the discharge opening. The discharge opening closure device 50 may comprise any suitable device that is configured to substantially prevent undesired flow of printer fluid through the discharge opening.

In this respect, the discharge opening closure device 50 may include a miniature valve that allows printer fluid to flow therethrough when a sufficient amount of pressure is applied on the valve by the printer fluid in the tubular member 12. Additionally, the discharge opening closure device 50 may be configured to force printer fluid to follow a circular profile and substantially prevents the printer fluid from escaping through the discharge opening (e.g., by virtue of centrifugal force) until sufficient pressure is applied on the printer fluid to eject a predetermined amount of printer fluid. Moreover, the discharge opening closure device 50 may be configured to produce a venturi effect, i.e., the tubular member 12 may be narrower near the discharge opening 24, such that, the pressure on top of the discharge opening becomes lower, thus avoiding printer fluid from exiting the discharge opening until the second fluid path 22 is closed. Still further, both the first and second fluid paths 20, 22 may be located at a lower height than a height of an channel that connects the external opening with the first and second fluid paths 20, 22. For example, an "elbow" type of channel may be implemented to accelerate printer fluid in the lower level and when the second fluid path 22 is closed, the printer fluid may move to the elbow channel to thus exit through the discharge opening 24. As another example, a mechanical actuator may be implemented as the discharge opening closure device 50. It is to be understood that the present invention is not limited to the above-recited techniques for preventing undesired printer fluid ejection from the tubular member 12. Rather, the present invention may operate properly with any suitable technique for preventing such undesired printer fluid ejection.

Referring again to FIG. 2, the first printer fluid path 20 possesses a plurality of elements 26–40 configured to cause the printer fluid 14 to flow substantially rapidly through the generally tubular member 12. In this respect, the elements 26–40 may comprise any suitable device capable of applying sufficient pressure on the printer fluid to cause a portion thereof to be expelled through the discharge opening 24 at a substantially high rate of speed. For example, the elements 26–40 may comprise heat generating components (300–314 in FIGS. 3A–3C), piezoelectric elements, i.e., pieces of material that deform under the influence of an electric field to thus apply pressure on the printer fluid in the generally tubular member 12 to eject an ink drop (500–514 in FIGS. 5A–5C), etc. Although the elements 26–40 are illustrated in FIG. 2 as being composed of a plurality of separate elements, it is to be appreciated that the elements may be formed as a single element without deviating from the scope and spirit of the present invention. In the instance that a single element is utilized, the element may be capable of becoming operable in a sequential manner, i.e., from a left side thereof to a right side, or as a whole.

A discharge section 42 of the printer fluid 14 denotes that part of the printer fluid which is to be ejected through the discharge opening 24. Although a certain portion of the discharge section 42 has been illustrated as constituting the amount of printer fluid 14 that is to be ejected, according to the principles of the present invention, it is possible to vary that amount, as will become more apparent from the following discussion. Additionally, it is to be understood that the specification and drawings disclose eight (8) elements 26–40 for illustrative purposes only and that the number of elements illustrated and discussed throughout the present disclosure is not intended to limit the present invention in any respect. Instead, it is to be further understood that the present invention may be practiced with any reasonable number of elements including one element as described hereinabove.

Figure 3A:
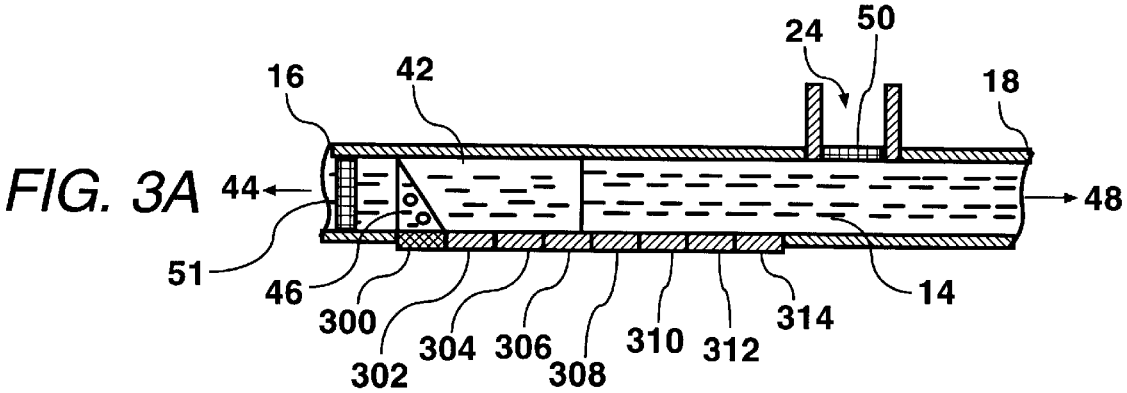
FIGS. 3A–3D sequentially illustrate a manner of operating the ink jet device depicted in FIG. 2 in which heat generating elements are implemented to cause printer fluid to be pressurized and ejected out of the ink jet device.

FIGS. 3A–3D together generally illustrate a manner of operating the ink jet device 10 depicted in FIG. 2 with the elements 26–40 constituting heat generating elements 300–314. With particular reference to FIG. 3A, an end section 16 of the generally tubular member 12 may be substantially blocked off with a first tube closure 51 to substantially impede the printer fluid 14 from flowing in a direction 44. The first tube closure 51 may comprise any suitable closure device, for example, a valve, closing off a printer fluid reservoir located in a direction 44, or the like, or, it may be blocked off with a blocking system 54 (to be discussed later with particular reference to FIGS. 6A and 6B). Additional possible techniques for substantially blocking off the end section 16 may include, a miniature check valve that opens in one direction and closes when the flow goes in the opposite direction, a pressure stroke in the opposite direction formed by a relatively large resistor/train of resistors on the secondary fluid path, etc.

Figure 3B:
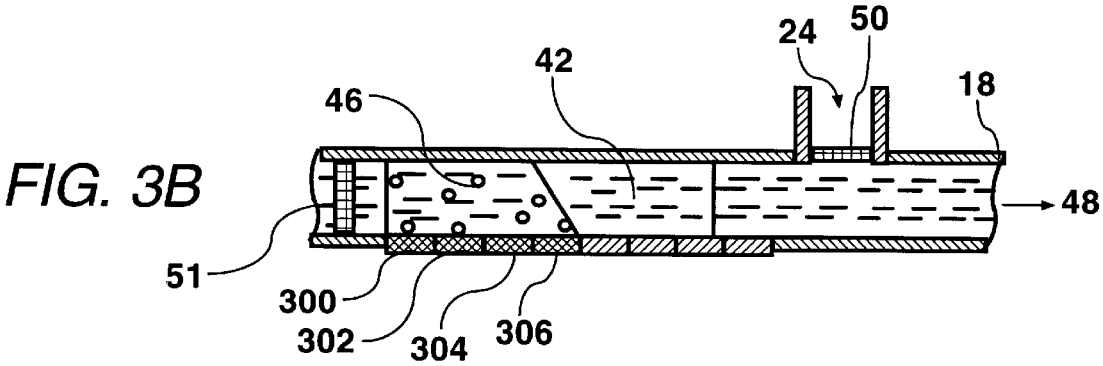

In FIG. 3A, the heat generating element 300 is shaded to denote that it has been activated, i.e., heat generating element 300 has been turned on to heat the section of the printer fluid 14 located above and around the heat generating element 300. As illustrated in FIG. 3A, when the printer fluid 14 located above the heat generating element 300 is sufficiently heated, a portion of that section vaporizes 46, thereby expanding and causing the discharge portion 42 to be pushed in a direction 48, generally toward the discharge opening 24. The heat generating elements 300–314 are activated sequentially to force the discharge portion 42 to be increasingly pushed toward the discharge opening 24 (FIG. 3B). Generally speaking, each of the heat generating elements 300–314 is activated for a time sufficient to cause the printer fluid located on top of the respective heat generating element to start the nucleation of a bubble. In addition, a delay between the activation of one heat generating element and the next heat generating element may be implemented to optimize the printer fluid firing sequence. Moreover, according to an aspect of the present invention, the total amount of time required to fire the entire row of heat generating elements is similar to the time a conventional thermal ink jet device requires to fire its resistor. In this respect, relatively high firing frequencies may be achieved by implementation of the present invention.

As illustrated in FIG. 3B, the discharge opening closure 50 remains in a closed position or otherwise substantially impedes the flow of printer fluid 14 through the discharge opening 24. Thus, as that portion 46 of the printer fluid 14 continues to vaporize and expand, the printer fluid 14 located upstream (i.e., in a direction 48 with respect to the discharge portion 42) generally flows toward direction 48. In this respect, the end section 18 may possess a printer fluid reservoir (not shown) to collect printer fluid 14 which has not been ejected. Additionally, the printer fluid reservoir may further possess a means for re-inserting the unused printer fluid back into the ink jet device 10 (also not shown).

Figure 3C:
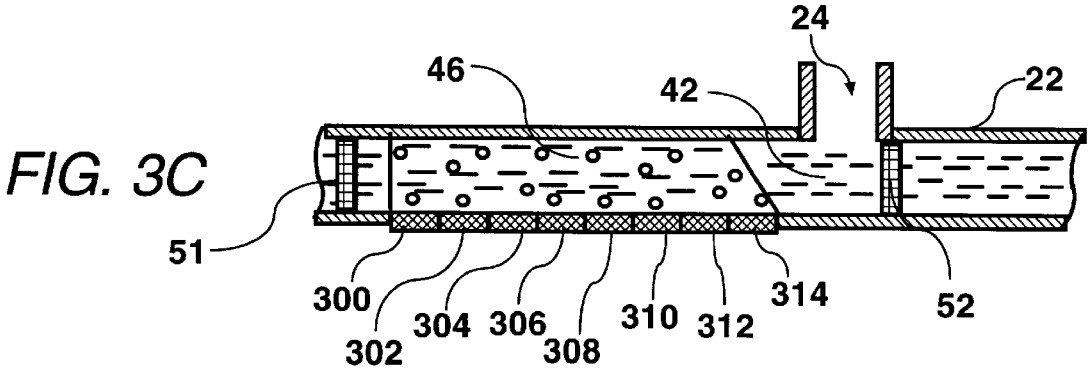

As illustrated in FIG. 3C, once the discharge portion 42 of printer fluid 14 is in position to be ejected through the discharge opening 24, a path closure device 52 is implemented to prevent the discharge portion from entering into the second printer fluid path 22. As the path closure device 52 is implemented, the pressure of the printer fluid 14 in the tubular member 12 becomes sufficiently pressurized to cause the discharge portion 42 to exit through the discharge opening 24.

Figure 3D:
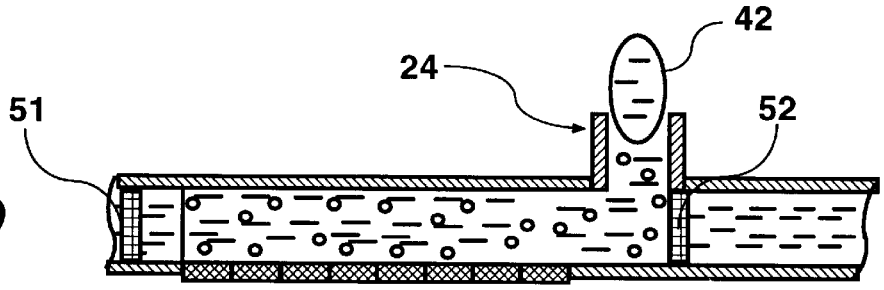

Referring now to FIG. 3D, it may be seen that the discharge portion 42 is ejected through the discharge opening 24 as an ink droplet. Due to the amount of pressure applied upon the discharge portion 42 by the vaporized and expanded portion 46 of the printer fluid 14, by the time the discharge portion reaches the discharge opening, the discharge portion 42 is traveling at a relatively high rate of speed. Accordingly, the discharge portion 42 is also ejected through the discharge opening 24 at a relatively high rate of speed. Although the path closure device 52 is illustrated as being generally perpendicular to the flow of the printer fluid 14, it is within the purview of the present invention that the path closure device may be angled or curved in a manner to facilitate the change in direction of the discharge portion 42 (not shown). Additionally, although the path closure device 52 is illustrated as generally being located adjacent to the discharge opening 24, it is also within the purview of the present invention that the path closure device 52 may be located generally downstream of the discharge opening 24. In this instance, the discharge portion 42 may be forced out through the discharge opening 24 by being substantially blocked by printer fluid 14 located generally upstream of the discharge portion.

Although FIGS. 3A–3D depict each of the heat generating elements 300–314 as remaining active after being activated, it is within the purview of the present invention that each of the heat generating elements may be deactivated some time after each one has been activated without deviating from the scope and spirit of the present invention. Additionally, the present invention may be practiced by sequentially activating more than one heat generating element at a time, i.e., two or more adjacent heat generating elements may be activated and deactivated simultaneously. It is to be appreciated that the operation of the heat generating elements 300–314 discussed hereinabove may be implemented according to a variety of factors. For example, optimization, energy conservation, etc.

Figure 4:
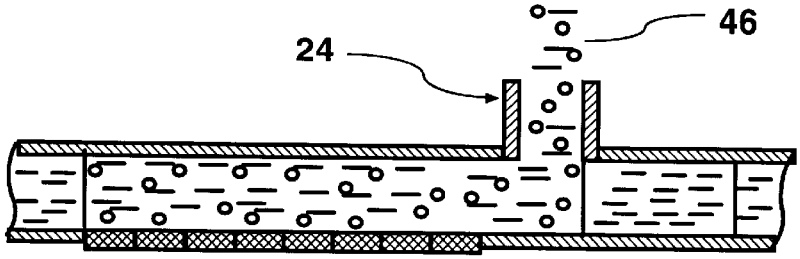
FIG. 4 is similar to FIG. 3D except that instead of ejecting an ink droplet, vaporized printer fluid is illustrated as being ejected from the ink jet device.

FIG. 4 is similar to FIG. 3D, except that vaporized printer fluid 46 is illustrated as being ejected from the ink jet device 10 through the discharge opening 24. In this instance, the printer fluid 46 does not exit the ink jet device 10 until substantially all of the printer fluid 14, including the discharge portion 42, has passed the discharge opening 24. It is to be understood that the amount of printer fluid 14 ejected through the discharge opening 24 may be modulated to contain a predetermined amount of fluid and vapor. Accordingly, the discharge from ink jet device 10 may be substantially completely printer fluid 14, a combination of printer fluid and vapor 46, or substantially completely vapor 46.

Figure 5A:
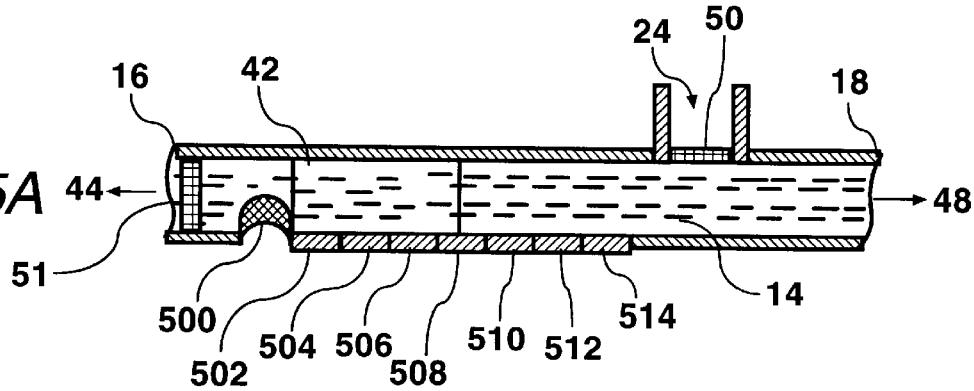
FIGS. 5A–5C sequentially illustrate a manner of operating the ink jet device depicted in FIG. 2 in which piezoelectric elements are implemented to cause printer fluid to be pressurized and ejected out of the ink jet device.
Figure 5B:
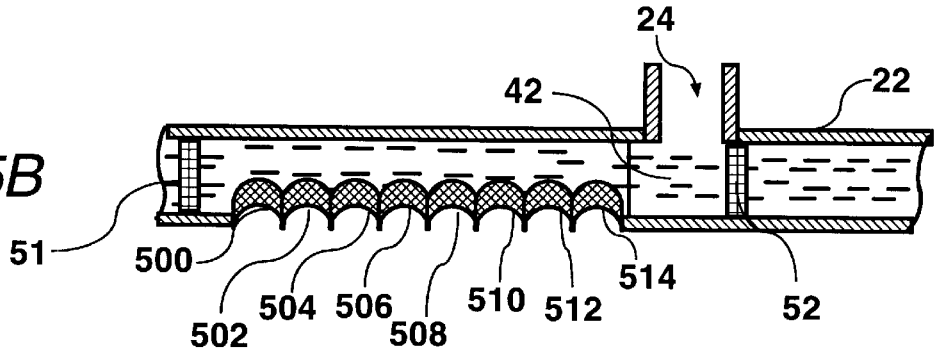
Figure 5C:
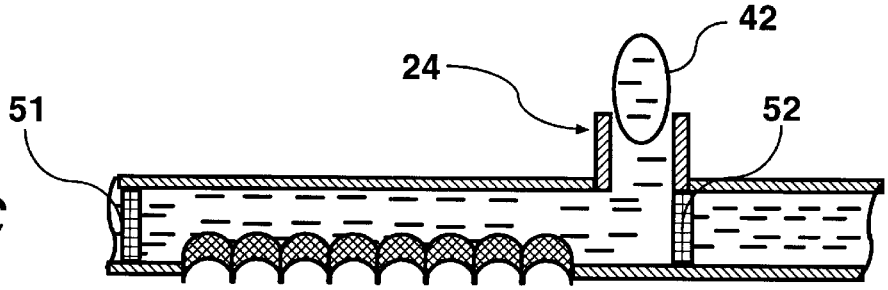

FIGS. 5A–5C together schematically illustrate a manner of operating the ink jet device 10 depicted in FIG. 2 with the elements 26–40 constituting piezoelectric elements 500–514. As seen in FIG. 5A, an end section 16 of the generally tubular member 12 may be substantially blocked off with a first tube closure 51 to substantially impede the printer fluid 14 from flowing in a direction 44 in a manner identical to that described hereinabove with respect to FIG. 3A. In addition, the discussion above pertaining to the components of the ink jet device 10 with respect to FIGS. 3A–3D are applicable to the ink jet device illustrated in FIGS. 5A–5C, except for the piezoelectric elements 500–514. Therefore, the following discussion of FIGS. 5A–5C will be substantially limited to the operation of the ink jet device in terms of the piezoelectric elements 500–514.

In FIG. 5A, the piezoelectric element 500 is illustrated to denote that it has been activated, i.e., an electric current has been applied to the piezoelectric element 500 causing it to become deformed, thereby applying pressure on the section of the printer fluid 14 located above and around the piezoelectric element 500. As illustrated in FIG. 5A, when the piezoelectric element 500 becomes sufficiently deformed, the discharge portion 42 of the printer fluid 14 is caused to move in the direction 48, generally toward the discharge opening 24.

The piezoelectric elements 500–514 may be activated sequentially to force the discharge portion 42 to be increasingly pressurized and therefore increasing pushed toward the discharge opening 24 (FIG. 5B). Generally speaking, each of the piezoelectric elements 500–514 may be activated for a set period of time, e.g., to optimize the firing sequence of the discharge portion. In addition, a delay between the activation of one piezoelectric element and the next piezoelectric element may be implemented to optimize the printer fluid firing sequence. Moreover, according to an aspect of the present invention, the total amount of time required to activate the entire row of piezoelectric elements is similar to the time a conventional piezoelectric ink jet device requires to fire an ink drop. In this respect, relatively high firing frequencies may be achieved by implementation of the present invention.

As illustrated in FIG. 5B, once the discharge portion 42 of printer fluid 14 is in position to be ejected through the discharge opening 24, a path closure device 52 is implemented to prevent the discharge portion from entering into the second printer fluid path 22. As the path closure device 52 is implemented, the pressure of the printer fluid 14 in the tubular member 12 becomes sufficiently pressurized to cause the discharge portion 42 to exit through the discharge opening 24.

Referring now to FIG. 5C, it is seen that the discharge portion 42 is ejected through the discharge opening 24 as an ink droplet. Due to the amount of pressure applied upon the discharge portion 42 by the deformation of the piezoelectric elements 500–514, by the time the discharge portion reaches the discharge opening, the discharge portion 42 is traveling at a relatively high rate of speed. Accordingly, the discharge portion 42 is also ejected through the discharge opening 24 at a relatively high rate of speed.

Although FIGS. 5A–5C depict each of the piezoelectric elements 500–514 as remaining deformed after being activated, it is within the purview of the present invention that each of the piezoelectric elements may be deactivated some time after each one has been activated without deviating from the scope and spirit of the present invention. Additionally, the present invention may be practiced by sequentially activating more than one piezoelectric element at a time, i.e., two or more adjacent piezoelectric elements may be activated and deactivated simultaneously. It is to be appreciated that the operation of the piezoelectric elements 500–514 discussed hereinabove may be implemented according to a variety of factors. For example, optimization, energy conservation, etc.

Figure 6A:
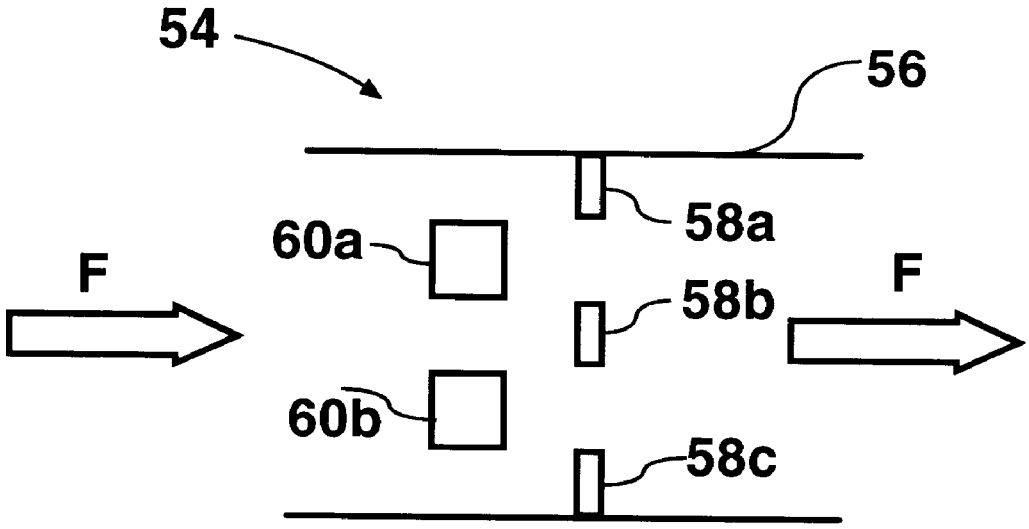
FIGS. 6A and 6B schematically illustrate a system and manner for substantially impeding the flow of printer fluid through an ink jet device in accordance with the principles of the present invention.
Figure 6B:
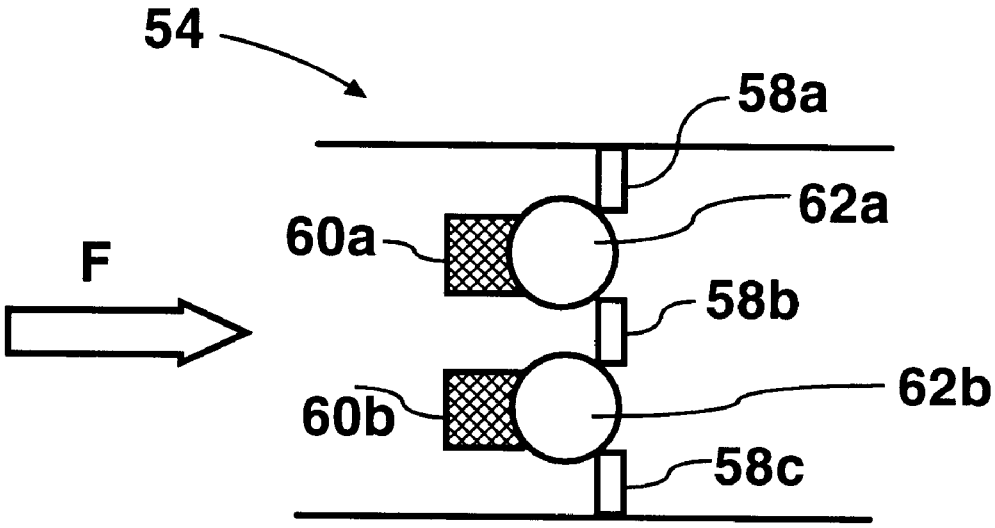

FIGS. 6A and 6B illustrate a schematic diagram of a system 54 and a manner of substantially blocking the flow of printer fluid through an ink jet device in accordance with the principles of the present invention. Referring first to FIG. 6A, the blocking system 54 generally includes a plurality of walls 58*a*–58*c* and a plurality of heat generating components 60*a*, 60*b*, configured for attachment within a part of an ink jet device 10. The heat generating components 60*a*, 60*b* and the walls 58*a*–58*c* are generally positioned to enable printer fluid to flow therethrough, as depicted by the arrows F. Additionally, the heat generating components 60*a* and 60*b* are illustrated as generally being positioned directly upstream of gaps positioned between each of the walls 58*a*–58*c*.

In operation, as illustrated in FIG. 6B, when it is desired to substantially impede the flow of a printer fluid through a section of an ink jet device, the heat generating components 60*a* and 60*b* are activated to relatively rapidly heat a portion of the printer fluid flowing over the heat generating components. One result of relatively rapidly heating a portion of the printer fluid is that a vapor bubble may be formed in the printer fluid. In this respect, as illustrated in FIG. 6B, by relatively rapidly heating the printer fluid positioned over each of the heat generating components 60*a* and 60*b*, the openings between the walls 58*a*–58*c* may be substantially blocked off by a plurality of vapor bubbles 62*a* and 62*b*. If it is desired to merely reduce the flow of the printer fluid through a particular section of an ink jet device, it may be possible to block only one of the spaces between the walls 58*a*–58*c* by forming a vapor bubble with only one of the heat generating components, for example, 60*a*. Thus, the blocking system 54 is operable to both reduce or substantially impede the flow of printer fluid. After the formation of the vapor bubbles 62*a* and 62*b*, it is possible to remove the vapor bubbles by allowing the vapor bubbles to become cooled or by providing a backflow of printer fluid. Additionally, a pump may be provided beneath a location of the vapor bubbles 62*a* and 62*b* to remove the vapor bubbles and to substantially restore fluid flow through the ink jet device.

Although FIGS. 6A and 6B show three walls 58*a*–58*c* and two heat generating components 60*a*, 60*b*, it is to be understood that the present invention may include any reasonable number of walls and heat generating components to substantially impede the flow of a printer fluid through a section of an ink jet device. By virtue of the provision of additional walls and heat generating components, the number of vapor bubbles formed may be additionally manipulated to thereby further control the flow of printer fluid through the ink jet device. In addition, although the blocking system 54 is illustrated in two dimensions in FIGS. 6A and 6B, it is also to be understood that the blocking system may be incorporated into a three dimensional system in any known reasonable manner which enables for the blocking system to substantially impede the flow of a printer fluid through a section of an ink jet device.

As stated hereinabove with respect to FIG. 2, the blocking system 54 and method illustrated in FIGS. 6A and 6B are applicable on the ink jet device 10 to substantially impede the flow of the printer fluid 14 through various locations throughout the ink jet device. In this respect, for example, the blocking system 54 and its attendant manner of use may be implemented to substantially impede the flow of printer fluid 14 in the direction 44, through the discharge opening 24, illustrated in FIG. 3A; and in the direction 48, illustrated in FIG. 3C, at those times discussed above with respect to a manner of operating the ink jet device 10.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. An ink jet device comprising:

a first fluid path;

a second fluid path;

a discharge opening through which a printer fluid is configured to be ejected from said ink jet device, said discharge opening being located between said first fluid path and said second fluid path;

at least one pressurizing element located in said first fluid path configured to cause said printer fluid to become pressurized in said first fluid path; and a second fluid path closure device for substantially impeding a flow of said printer fluid through said second fluid path.

2. The ink jet device according to claim 1, wherein said at least one pressuring element comprises a heat generating element.

3. The ink jet device according to claim 1, wherein said at least one pressurizing element comprises a piezoelectric element.

4. The ink jet device according to claim 1, wherein said discharge opening is configured to be closed by a discharge opening closure apparatus operable to substantially impede the flow of printer fluid therethrough when said printer fluid is below a predetermined pressure.

5. The ink jet device according to claim 4, wherein said discharge opening closure apparatus comprises a blocking system having a plurality of walls, at least one space between said walls, and at least one heat generating component, said at least one heat generating component being operable to create at least one vapor bubble from said printer fluid, wherein said vapor bubble is operable to substantially block said at least one space.

6. The ink jet device according to claim 1, further comprising a first fluid path closure device for substantially impeding the flow of said printer fluid through said first fluid path, said first fluid path closure device being located generally upstream of said at least one pressurizing element.

7. The ink jet device according to claim 6, wherein said first fluid path closure device comprises a blocking system having a plurality of walls, at least one space between said walls, and at least one heat generating component, said at least one heat generating component being operable to create at least one vapor bubble from said printer fluid, wherein said vapor bubble is operable to substantially block said at least one space.

8. An ink jet device comprising:

a first fluid path;

a second fluid path;

a discharge opening through which a printer fluid is configured to be ejected from said ink jet device, said discharge opening being located between said first fluid path and said second fluid path;

at least one pressurizing element located in said first fluid path configured to cause said printer fluid to become pressurized in said first fluid path;

a second fluid path closure device for substantially impeding a flow of said printer fluid through said second fluid path; and wherein said second fluid path closure device comprises a blocking system having a plurality, of walls, at least one space between said walls, and at least one heat generating component, said at least one heat generating component being operable to create at least one vapor bubble from said printer fluid, wherein said vapor bubble is operable to substantially block said at least one space.

9. An ink jet device comprising:

a first fluid path;

a second fluid path;

a discharge opening through which a printer fluid is configured to be ejected from said ink jet device, said discharge opening being located between said first fluid path and said second fluid path;

at least one pressurizing element located in said first fluid path configured to cause said printer fluid to become pressurized in said first fluid path;

a second fluid path closure device for substantially impeding a flow of said printer fluid through said second fluid path;

wherein said discharge opening is configured to be closed by a discharge opening closure apparatus operable to substantially impede the flow of printer fluid therethrough when said printer fluid is below a predetermined pressure; and wherein said discharge opening closure apparatus comprises a pressure sensitive valve configured to open when said second fluid path closure device substantially impedes the flow of printer fluid through said second fluid path.

10. A method of recording on a printing medium comprising the steps of:

substantially filling a first fluid path and a second fluid path with a printer fluid, wherein a discharge opening is located between said first fluid path and said second fluid path;

activating at least one pressurizing element located in said first fluid path, causing said printer fluid to flow in a direction toward said second fluid path in response to a pressure caused by the activation of said at least one pressurizing element;

substantially impeding said flow of said printer fluid through said second fluid path; and ejecting at least a portion of said printer fluid through said discharge opening.

11. The method of recording according to claim 10, wherein said step of ejecting at least a portion of said printer fluid comprises the further step of:

ejecting a predetermined volume of printer fluid through said discharge opening.

12. The method of recording according to claim 10, wherein said step of activating at least one pressurizing element comprises the step of:

heating said printer fluid adjacent to at least one heat generating component;

causing at least a portion of said printer fluid adjacent to said heat generating component to become vaporized; and wherein said heating and vaporizing of said printer fluid causes said printer fluid to become pressurized within said first and second fluid paths.

13. The method of recording according to claim 12, wherein said step of ejecting at least a portion of said printer fluid comprises the further step of:

ejecting a combination of said printer fluid and said vaporized printer fluid through said discharge opening.

14. The method of recording according to claim 12, wherein said step of ejecting at least a portion of said printer fluid comprises the further step of:

ejecting substantially only said vaporized printer fluid through said discharge opening.

15. The method of recording according to claim 10, wherein said step of activating at least one pressurizing element comprises the step of:

pressurizing said printer fluid adjacent to at least one piezoelectric element by substantially deforming said at least one piezoelectric element.

16. The method of recording according to claim 10, further comprising the step of:

substantially impeding said flow of said printer fluid through said first fluid path in a direction generally away from said discharge opening prior to performing said step of activating at least one pressurizing element.

17. The method of recording according to claim 10, wherein said step of substantially impeding said flow of said printer fluid comprises the further step of:

forming at least one vapor bubble in said flow of said printer fluid by activating at least one heat generating component to heat a portion of said printer fluid, wherein said at least one vapor bubble is configured to substantially block a passageway of said printer fluid.

18. A method of recording on a printing medium comprising the steps of:

substantially filling a first fluid path and a second fluid path with a printer fluid, wherein a discharge opening is located between said first fluid path and said second fluid path;

activating at least one pressurizing element located in said first fluid path, causing said printer fluid to flow in a direction toward said second fluid path in response to a pressure caused by the activation of said at least one pressurizing element;

substantially impeding said flow of said printer fluid through said second fluid path; and ejecting at least a portion of said printer fluid through said discharge opening;

wherein said step of activating at least one pressurizing element comprises:

heating said printer fluid adjacent to at least one heat generating component;

causing at least a portion of said printer fluid adjacent to said heat generating component to become vaporized;

sequentially activating a plurality of heat generating components; and wherein said heating and vaporizing of said printer fluid causes said printer fluid to become pressurized within said first and second fluid paths.

19. A method of recording on a printing medium comprising the steps of:

substantially filling a first fluid path and a second fluid path with a printer fluid, wherein a discharge opening is located between said first fluid path and said second fluid path;

activating at least one pressurizing element located in said first fluid path, causing said printer fluid to flow in a direction toward said second fluid path in response to a pressure caused by the activation of said at least one pressurizing element;

substantially impeding said flow of said printer fluid through said second fluid path; and ejecting at least a portion of said printer fluid through said discharge opening;

wherein said step of activating at least one pressurizing element comprises:

pressurizing said printer fluid adjacent to a plurality of piezoelectric elements by substantially deforming and by sequentially activating said plurality of piezoelectric elements.

20. A method of ejecting a modulated volume of a printer fluid from an ink jet device, said method comprising the steps of:

pressurizing a printer fluid within a first fluid path of said ink jet device;

causing a portion of said printing fluid to be forced toward a second fluid path of said ink jet device in response to said pressurizing step;

substantially impeding the flow of said printer fluid in said second fluid path at a predetermined time after said pressurizing step;

ejecting at least a portion of said printer fluid through a discharge opening located between said first and second fluid paths in response to said printer fluid flow impeding step; and modulating the volume of said ejected printer fluid by varying the time the substantially impeding step is implemented following said pressurizing step.

21. The method according to claim 20, further comprising the step of:

substantially impeding a flow of said printer fluid through said first fluid path in a direction generally away from said discharge opening prior to performing said pressurizing step.

22. The method according to claim 20, wherein said pressurizing step comprises the step of:

heating said printer fluid adjacent to at least one heat generating component; and causing at least a portion of said printer fluid adjacent to said heat generating component to become vaporized.

23. The method according to claim 22, wherein said printer fluid ejecting step further comprises the step of:

ejecting a combination of said printer fluid and said vaporized printer fluid through said discharge opening.

24. The method according to claim 22, wherein said step of ejecting at least a portion of said printer fluid comprises the further step of:

ejecting substantially only said vaporized printer fluid through said discharge opening.

25. The method according to claim 20, wherein said pressurizing step comprises the further step of:

pressurizing said printer fluid adjacent to at least one piezoelectric element by substantially deforming said at least one piezoelectric element.

* * * * *